US011002498B2

(12) United States Patent
Nakanishi et al.

(10) Patent No.: US 11,002,498 B2
(45) Date of Patent: May 11, 2021

(54) ALUMINUM ALLOY FIN MATERIAL FOR HEAT EXCHANGER EXCELLENT IN STRENGTH, ELECTRICAL CONDUCTIVITY, AND BRAZEABILITY, METHOD FOR MANUFACTURING ALUMINUM ALLOY FIN MATERIAL FOR HEAT EXCHANGER, AND HEAT EXCHANGER COMPRISING ALUMINUM ALLOY FIN MATERIAL FOR HEAT EXCHANGER

(71) Applicants: MITSUBISHI ALUMINUM CO., LTD., Tokyo (JP); DENSO CORPORATION, Kariya (JP)

(72) Inventors: Shigeki Nakanishi, Susono (JP); Shohei Iwao, Susono (JP); Masakazu Edo, Susono (JP); Hayaki Teramoto, Okazaki (JP); Manabu Hasegawa, Obu (JP); Michiyasu Yamamoto, Chiryu (JP); Shoei Teshima, Handa (JP)

(73) Assignees: MITSUBISHI ALUMINUM CO., LTD., Tokyo (JP); DENSO CORPORATION, Aichi-ken (JP)

( * ) Notice: Subject to any disclaimer, the term of this patent is extended or adjusted under 35 U.S.C. 154(b) by 757 days.

(21) Appl. No.: 14/980,138

(22) Filed: Dec. 28, 2015

(65) Prior Publication Data

US 2016/0187079 A1 Jun. 30, 2016

(30) Foreign Application Priority Data

Dec. 24, 2014 (JP) ..... JP2014-260686
Nov. 20, 2015 (JP) ..... JP2015-227685

(51) Int. Cl.

| | |
|---|---|
| ***F28F 21/08*** | (2006.01) |
| ***C22C 21/10*** | (2006.01) |
| ***C22C 21/00*** | (2006.01) |
| ***C22F 1/04*** | (2006.01) |
| ***C22F 1/053*** | (2006.01) |
| ***C22F 1/00*** | (2006.01) |
| ***C21D 9/00*** | (2006.01) |
| ***B22D 7/00*** | (2006.01) |
| ***B22D 21/00*** | (2006.01) |

(52) U.S. Cl.

CPC ..... *F28F 21/084* (2013.01); *B22D 7/005* (2013.01); *B22D 21/007* (2013.01); *C21D 9/0081* (2013.01); *C22C 21/00* (2013.01); *C22C 21/10* (2013.01); *C22F 1/00* (2013.01); *C22F 1/04* (2013.01); *C22F 1/053* (2013.01)

(58) Field of Classification Search

CPC ..... C22C 21/00; C22C 21/10; F28F 21/084
See application file for complete search history.

(56) References Cited

U.S. PATENT DOCUMENTS

| | | | | |
|---|---|---|---|---|
| 8,932,728 | B2 | 1/2015 | Matsumoto et al. | |
| 8,999,083 | B2 | 4/2015 | Suzuki et al. | |
| 2013/0244051 | A1 | 9/2013 | Matsumoto et al. | |
| 2016/0040947 | A1* | 2/2016 | Gatenby | B22D 21/04 165/185 |
| 2016/0195346 | A1* | 7/2016 | Howells | C22C 21/00 165/134.1 |

FOREIGN PATENT DOCUMENTS

| | | | |
|---|---|---|---|
| CN | 101230431 | A | 7/2008 |
| CN | 103305724 | A | 9/2013 |
| CN | 104220835 | A | 12/2014 |
| JP | 2001335901 | A | 12/2001 |
| JP | 2008038166 | A | 2/2008 |
| JP | 2012026008 | A | 2/2012 |

* cited by examiner

*Primary Examiner* — George Wyszomierski
*Assistant Examiner* — Janell C Morillo
(74) *Attorney, Agent, or Firm* — Holtz, Holtz & Volek PC

(57) ABSTRACT

An aluminum alloy fin material for a heat exchanger in the present invention comprises an aluminum alloy having a composition containing Mn: 1.2 to 2.0%, Cu: 0.05 to 0.20%, Si: 0.5 to 1.30%, Fe: 0.05 to 0.5%, and Zn: 1.0 to 3.0% by mass and a remainder comprising Al and an unavoidable impurity, further containing one or two or more of Ti: 0.01 to 0.20%, Cr: 0.01 to 0.20% and Mg: 0.01 to 0.20% by mass as desired, and, after heating in brazing, has a tensile strength of 140 MPa or more, a proof stress of 50 MPa or more, an electrical conductivity of 42% IACS or more, an average grain diameter of 150 μm or more and less than 700 μm, and a potential of −800 mV or more and −720 mV or less.

9 Claims, No Drawings

ALUMINUM ALLOY FIN MATERIAL FOR HEAT EXCHANGER EXCELLENT IN STRENGTH, ELECTRICAL CONDUCTIVITY, AND BRAZEABILITY, METHOD FOR MANUFACTURING ALUMINUM ALLOY FIN MATERIAL FOR HEAT EXCHANGER, AND HEAT EXCHANGER COMPRISING ALUMINUM ALLOY FIN MATERIAL FOR HEAT EXCHANGER

CROSS-REFERENCE TO RELATED APPLICATION

The present application claims priority under 35 U.S.C. § 119 to Japanese Patent Application No. 2014-260686 filed with Japan Patent Office on Dec. 24, 2014 and Japanese Patent Application No. 2015-227685 filed with Japan Patent Office on Nov. 20, 2015. The content of the application are incorporated herein by reference in their entirety.

BACKGROUND OF THE INVENTION

Field of the Invention

The present invention relates to an aluminum alloy fin material excellent in strength, electrical conductivity, and brazeability used in an automobile heat exchanger, a method for manufacturing the aluminum alloy fin material for a heat exchanger, and a heat exchanger comprising the aluminum alloy fin material for a heat exchanger.

Description of the Related Art

High strength, high electrical conductivity, and brazeability after brazing are required of fin materials for automobile heat exchangers. But, all these properties are in a trade-off relationship, and therefore it is conventionally considered to be difficult to satisfy all properties. In the past, for example, Japanese Patent Laid-Open No. 2008-038166 and Japanese Patent Laid-Open No. 2001-335901 proposed fin materials excellent in strength and electrical conductivity after brazing. The fin materials proposed by Japanese Patent Laid-Open No. 2008-038166 and Japanese Patent Laid-Open No. 2001-335901 are fabricated by a manufacturing method based on a continuous casting and rolling method (referred to as "CC method") in which the slag cooling rate during casting is very fast, for example, several tens of ° C./s or more, and a thin plate is directly fabricated from a molten metal.

On the other hand, for example, in a fin material using a semicontinuous casting method (hereinafter referred to as "DC method") in which the slag cooling rate during casting is 10° C./s or less, crystallized products as fine as those in continuous casting are not obtained during casting, and the crystallized product size is 1 μm or more and is likely to coarsen. In this case, coarse crystallized products present in the material become nucleation sites for recrystallization during heating in brazing, and thus the grains are likely to refine, erosion starting from grain boundaries is likely to occur, and the brazeability is poor.

In addition, in the semicontinuous casting method, heat treatment at a high temperature around 500° C. referred to as homogenization treatment is generally applied to an ingot obtained by casting for the purpose of the homogenization of segregation, and the like. Further, soaking treatment at 500° C. or more is essential before hot rolling in order to suppress a reduction in deformation resistance and the occurrence of cracks during rolling.

But, due to the heat treatment applied to the material according to the DC method, the precipitation of the added elements dissolved in a supersaturated state during casting occurs, and when the heat treatment temperature is a high temperature of 500° C. or more, the second-phase particles are likely to coarsen, and influence on strength decrease is unavoidable.

As described above, in the DC method, the most general casting method, it is difficult to achieve high strength, high electrical conduction, and brazeability at the same time.

For such a problem, for example, Japanese Patent Laid-Open No. 2012-26008 proposes fin materials in which high strength and high electrical conductivity after brazing are achieved by defining the composition ratio of Mn, Si, and Fe and the types and dispersed state of the intermetallic compounds though the DC method is used. But, although these fin materials have an electrical conductivity as high as about 48% IACS after brazing, they have a strength of only about 130 MPa after brazing and do not have sufficient properties.

The present invention has been made with the above circumstances as a background, and it is an object of the present invention to provide an aluminum alloy fin material for a heat exchanger, having further improved strength and having brazeability improved by grain coarsening while ensuring an electrical conductivity of 42% IACS or more after brazing.

SUMMARY OF THE INVENTION

Here, as aluminum strengthening mechanisms, "solid solution strengthening" by added elements, "precipitation strengthening" in which a large number of extremely fine hard particles are dispersed by heat treatment, "grain refining strengthening" in which grains are refined, and the like are generally considered. But, problems are that the solid solution strengthening causes a decrease in electrical conductivity, and the grain refining strengthening causes a decrease in brazeability. In the present invention, attention has been paid to the "precipitation strengthening" as a strengthening mechanism. In the "precipitation strengthening," fine second-phase particles become a strong obstacle to dislocation, thereby contributing to strength improvement. In addition, the solid solubility of added elements decreases, and therefore the specific resistance decreases, and the electrical conductivity improves. In addition, these fine second-phase particles also have the effect of delaying recrystallization for coarsening by the fact that they are less likely to become nucleation sites for recrystallization and by suppressing dislocation and the migration rate of grain boundaries during recrystallization.

For the purpose of obtaining the ideal dispersed state of second-phase particles in order to make the most of this precipitation strengthening, attention has been paid to "homogenization treatment," and "soaking treatment" before hot rolling in the manufacturing process in the semicontinuous casting method (DC method).

In other words, in the present invention, attention has been paid to the dispersed state of fine intermetallic compounds in a material, and by allowing unprecedented fine and dense second-phase particles to be stably present by optimum chemical components and an optimum manufacturing process, higher strength by precipitation strengthening, high electrical conductivity by a reduction in amounts dissolved, and grain coarsening by fine precipitation have been achieved at high levels to obtain a fin material excellent in strength, electrical conductivity, and brazeability at the same time, which has not been achieved only by making chemical components proper in the semicontinuous casting method so far.

Specifically, of an aluminum alloy fin material for a heat exchanger according to first aspect of the present invention, the first present invention comprises an aluminum alloy having a composition containing Mn: 1.2 to 2.0%, Cu: 0.05 to 0.20%, Si: 0.5 to 1.30%, Fe: 0.05 to 0.5%, and Zn: 1.0 to 3.0% in terms of % by mass and a remainder comprising Al and an unavoidable impurity, and, after heating in brazing, has a tensile strength of 140 MPa or more, a proof stress of 50 MPa or more, an electrical conductivity of 42% IACS or more, an average grain diameter of 150 μm or more and less than 700 μm, and a potential of −800 mV or more and −720 mV or less.

In an aluminum alloy fin material for a heat exchanger according to the second aspect of the present invention, in the first present invention, the aluminum alloy further contains one or two or more of Ti: 0.01 to 0.20%, Cr: 0.01 to 0.20%, and Mg: 0.01 to 0.20% in terms of % by mass.

An aluminum alloy fin material for a heat exchanger according to the third aspect of the present invention has, at 115° C. after brazing, a tensile strength of 90 MPa or more and a proof stress of 40 MPa or more at high temperature strength in the first or second present invention.

An aluminum alloy fin material for a heat exchanger according to the fourth aspect of the present invention has an electrical conductivity of 45% IACS or more before brazing, wherein, before brazing, less than $5.0\times10^4/mm^2$ of crystallized products having an equivalent circular diameter of 1.0 μm or more and $5.0\times10^4/mm^2$ or more of Al—Mn-based, Al—Mn—Si-based, and Al—Fe—Si-based second-phase particles having an equivalent circular diameter of 0.01 to 0.10 μm are present in any of the first to third present inventions.

In an aluminum alloy fin material for a heat exchanger according to the fifth aspect of the present invention, in any of the first to fourth present inventions, $1.0\times10^4/mm^2$ or more of Al—Mn-based, Al—Mn—Si-based, and Al—Fe—Si-based second-phase particles having an equivalent circular diameter of 0.01 to 0.10 μm are present, after heating in brazing.

An aluminum alloy fin material for a heat exchanger according to the sixth aspect of the present invention has a plate thickness of 80 μm or less in any of the first to fifth present inventions.

In an aluminum alloy fin material for a heat exchanger according to the seventh aspect of the present invention, in any of the first to sixth present inventions, a temperature range from a start to an end of recrystallization for heating in brazing is 350° C. to 550° C.

A method for manufacturing an aluminum alloy fin material for a heat exchanger according to the eighth aspect of the present invention comprises steps of casting a molten aluminum alloy having the composition according to the first or second present invention by a semicontinuous casting method; subjecting an ingot obtained in the step to homogenization treatment at a treatment temperature of 350° C. to 480° C. for a treatment time of 1 to 10 hours; and carrying out soaking treatment with the temperature and treatment time of the homogenization treatment or less before hot rolling.

The heat exchanger of the ninth aspect of the present invention comprises the aluminum alloy fin material for a heat exchanger according to any of the first to eighth present inventions.

The reasons for the limitation of the composition and the like defined in the present invention will be described below. The content of each component below is represented by mass %.

Mn: 1.2 to 2.0%

Mn is contained in order to precipitate Al—(Mn, Fe)—Si-based intermetallic compounds and obtain strength after brazing by dispersion strengthening. However, when Mn is less than 1.2%, the dispersion strengthening effect of the Al—(Mn, Fe)—Si-based intermetallic compounds is small, and the desired strength after brazing is not obtained. On the other hand, when Mn is more than 2.0%, the amount of Mn dissolved increases, and the desired electrical conductivity after brazing is not obtained, and therefore the thermal conductivity is poor. In addition, the amount of Al—(Mn, Fe)-based coarse intermetallic compounds increases, and the cutting processability during fin molding decreases. For similar reasons, it is desired that the lower limit is 1.5%, and the upper limit is 1.8%.

Cu: 0.05 to 0.20%

Cu forms intermetallic compounds, and the strength improves by dispersion strengthening and solid solution strengthening. However, when the content is less than 0.05%, the influence on dispersion strengthening and solid solution strengthening is small, and the strength improving effect is small. On the other hand, when the Cu content is more than 0.20%, the solid solubility in the matrix increases, the electrical conductivity after brazing decreases, the thermal conductivity decreases, and the corrosion resistance of the fin alone decreases. For similar reasons, it is desired that the lower limit is 0.06%, and the upper limit is 0.15%.

Si: 0.5 to 1.30%

Si is contained in order to precipitate Al—(Mn, Fe)—Si-based intermetallic compounds and obtain strength after brazing by dispersion strengthening. However, when less than 0.5% of Si is contained, the dispersion strengthening effect of the Al—(Mn, Fe)—Si-based intermetallic compounds is small, and the desired strength after brazing is not obtained. On the other hand, when more than 1.30% of Si is contained, the amount of Si dissolved increases, and the desired electrical conductivity after brazing is not obtained, and therefore the thermal conductivity is poor. In addition, since the amount of Si dissolved increases, the solidus temperature (melting point) decreases, and significant erosion is likely to occur during brazing. For similar reasons, it is desired that the lower limit is 0.7%, and the upper limit is 1.2%.

Fe: 0.05 to 0.5%

Fe is contained in order to precipitate Al—(Mn, Fe)—Si-based and Al—(Mn, Fe)-based intermetallic compounds and obtain strength after brazing by dispersion strengthening. However, when less than 0.05% of Fe is contained, the dispersion strengthening effect of the Al—(Mn, Fe)—Si-based and Al—(Mn, Fe)-based intermetallic compounds is small, and the desired strength after brazing is not obtained. In addition, the proportion of Al—Mn—Si-based fine intermetallic compounds increases relatively, and these are likely to redissolve during brazing at about 600° C., and therefore after brazing, the electrical conductivity decreases, and the thermal conductivity decreases. On the other hand, when more than 0.5% of Fe is contained, the crystallized products during casting coarsen, and the manufacturability (rollability) decreases. In addition, the intermetallic compounds coarsen, and thus the die abrasion properties during fin molding decrease greatly. For similar reasons, it is desired that the lower limit is 0.10%, and the upper limit is 0.35%.

Zn: 1.0 to 3.0%

Zn has the action of making the potential of an aluminum alloy low and is contained in order to obtain a sacrificial anode effect. However, when less than 1.0% of Zn is contained, the potential is not sufficiently low, and therefore the desired sacrificial anode effect is not obtained, and the corrosion depth of a combined tube increases. On the other hand, when more than 3.0% of Zn is contained, the potential is excessively low, and the corrosion resistance of the fin alone decreases. For similar reasons, it is desired that the lower limit is 1.2%, and the upper limit is 2.2%.

One or Two or More of Ti: 0.01 to 0.20%, Cr: 0.01 to 0.20%, and Mg: 0.01 to 0.20%

Ti, Cr, and Mg form intermetallic compounds, and the strength improves by dispersion strengthening and solid solution strengthening, and therefore one or more are contained as desired. However, when each content is less than the lower limit, the influence on dispersion strengthening and solid solution strengthening is small, and the strength improving effect is small. When Ti and Cr are more than the respective upper limits, the crystallized products during casting coarsen, and the manufacturability decreases. In addition, when Mg is more than the upper limit, the brazeability is decreased.

Therefore, each content is determined in the above range. For similar reasons, it is desired to set Ti, Cr, and Mg: the lower limit 0.03% and the upper limit 0.15%.

A Tensile Strength of 140 MPa or More after Brazing

With the thinning of members, high strength materials are required. When the strength of the fin material after brazing is low, fin breakage is likely to occur due to repeated vibration applied to a heat exchanger when it is mounted in a vehicle, and the expansion and compression of cooling water. In such a broken portion, the tube expansion and compression suppressing effect of the fins is not obtained, and the tube expands like a drum, leading to breakage, that is, the leakage of internal cooling water, at an early stage. In the performance so far, it has been found that even when the fin plate thickness is 80 μm or less, fin breakage in the market can be significantly reduced when the fin material has a tensile strength of 140 MPa or more after brazing.

A Proof Stress of 50 MPa or More after Brazing

The proof stress indicates the elastic limit. When the proof stress after brazing is low, due to repeated vibration when a heat exchanger is mounted in a vehicle, plastic deformation occurs and the original shape is not retained though not leading to fin breakage, and since a plurality of fins deform, core shrinkage occurs. It has been found that even when the fin plate thickness is 80 μm or less, the above influence can be reduced when the fin material has a proof stress of 50 MPa or more after brazing.

An electrical conductivity of 42% IACS or more after brazing

In order to ensure the desired thermal conductivity, the electrical conductivity after brazing is 42% IACS or more.

An Average Grain Diameter of 150 μm or More and Less than 700 μm, after Brazing

When the average grain diameter after brazing is as fine as less than 150 μm, erosion using grain boundaries as paths is likely to occur, which is likely to cause the buckling of the fins. On the other hand, when the average grain diameter is coarse and is 700 μm or more, the influence on proof stress decrease increases due to the so-called Hall-Petch relationship. Particularly, in the case of a thin material, it is necessary to set an optimum grain diameter range considering brazeability and higher strength.

A Potential of −800 mV or More and −720 mV or Less after Brazing

When the potential of the fin material is less than −800 mV, the potential is excessively lower than that of another member joined, and therefore the corrosion of the fins accelerates due to galvanic corrosion. When the potential of the fins is more than −720 mV, the potential is not sufficiently lower than that of another member joined, and therefore a sacrificial anode effect is not obtained, and the corrosion of, for example, a tube material accelerates.

A Plate Thickness of 80 μm or Less

In order to achieve lighter weight, the plate thickness of the fin material is desirably 80 μm or less, and the strength improvement effect is significant. The lower limit is 25 μm.

A Tensile Strength of 90 MPa or More and a Proof Stress of 40 MPa or More, at High Temperature Strength at 115° C. after Brazing The temperature of a heat exchanger such as a radiator increases up to about 115° C. during use in the market. As the temperature of an aluminum member becomes higher, the material strength decreases. Therefore, the strength level at high temperature is also important in an actual environment. Even if the ordinary temperature strength after brazing is high, the effect decreases to half when the high temperature strength is low.

An Electrical Conductivity of 45% IACS (International Annealed Copper Standard) or More Before Brazing The solid solubility of each added element in the present invention is also high in a state before brazing, and the solid solubility increases further when the aluminum alloy fin material is subjected to brazing at about 600° C. As the solid solubility becomes higher, the electrical conductivity decreases. Therefore, when the electrical conductivity of the aluminum alloy fin material before brazing is less than 45% IACS, the desired electrical conductivity after brazing cannot be ensured, and therefore the desired thermal conductivity cannot be ensured. In addition, when the electrical conductivity before brazing is less than 45% IACS, the amount of each added element precipitated is small, and therefore the dispersion strengthening effect of each compound is small, and the desired strength after brazing is not obtained. For similar reasons, it is desired that the lower limit is 48% IACS. The upper limit is realistically 58% IACS.

Less than $5.0\times10^4/Mm^2$ of Crystallized Products Having an Equivalent Circular Diameter of 1.0 μm or More and $5.0\times10^4/mm^2$ or More of Al—Mn-Based, Al—Mn—Si-Based, and Al—Fe—Si-Based Second-Phase Particles Having an Equivalent Circular Diameter of 0.01 to 0.10 μm Before Brazing The dispersed state of the intermetallic compounds before brazing has a large influence mainly on recrystallization behavior during brazing. When the abundance of coarse crystallized products having an equivalent circular diameter of 1.0 μm or more is high, recrystallization is promoted during brazing because these become nucleation sites for recrystallization, and the grain diameter is fine (the brazeability decreases). On the other hand, fine second-phase particles having an equivalent circular diameter of 0.01 to 0.10 μm suppress transition to recrystallization sites and the accumulation of subgrain boundaries, and therefore recrystallization is delayed, and the grains coarsen (the brazeability improves).

Recrystallization Temperature (350 to 550° C.)

The recrystallization temperature range in heating in brazing greatly influences the brazeability of the fins. Generally, heating in brazing is performed in a temperature range around 600° C. In the process of temperature increase from ordinary temperature, on the low temperature side of 350° C. or less, the temperature increase rate is high, and as the temperature approaches 600° C. on the high temperature side, the temperature increase rate decreases. Here, in the former temperature range, the temperature increase rate is high, and therefore temperature difference occurs between the members of a heat exchanger, the thin fins whose actual temperature is likely to increase expand, and thermal stress occurs between the fins and the tube. Further, a problem is that when the recrystallization of the fins proceeds in this temperature range, the fin strength decreases, and the fins cannot withstand thermal stress, causing buckling, which is likely to result in brazing failure. Therefore, it is desired that the recrystallization start temperature during heating in brazing is 350° C. or more. On the other hand, when the recrystallization end temperature during heating in brazing is 550° C. or more, the sag properties decrease greatly due to texture change and an increase in high temperature creep during recrystallization. Therefore, it is desired that the recrystallization temperature range during heating in brazing is 350° C. to 550° C.

The recrystallization start temperature is the temperature at which the proof stress value starts to decrease by 20% or more compared with that before brazing (the material), and the end temperature is defined as the temperature at which the proof stress value starts to decrease to within +20% compared with that after heating in brazing.

$1.0\times10^4/mm^2$ or More of Al—Mn-Based, Al—Mn—Si-Based, and Al—Fe—Si-Based Second-Phase Particles Having an Equivalent Circular Diameter of 0.01 to 0.10 μm after Heating in Brazing The dispersed state of the intermetallic compounds after brazing mainly greatly influences material strength. Precipitation strengthening by fine second-phase particles having an equivalent circular diameter of 0.01 to 0.10 μm can be expected.

Homogenization Treatment at a Treatment Temperature of 350° C. to 480° C. for a Treatment Time of 1 to 10 Hours The ideal dispersed state of the intermetallic compounds is uniformly obtained in the matrix by treatment under the predetermined conditions. In the case of a temperature lower than the above range or a time shorter than the above range, sufficient precipitation does not proceed in the homogenization treatment, and nonuniform precipitation proceeds in the subsequent heat treatment step, which is not preferred. In addition, on the high temperature side higher than the above range or on the long time side longer than the above range, the second-phase particles are likely to coarsen, and the desired dispersed state of the intermetallic compounds is not obtained.

Carrying Out Soaking Treatment Before Hot Rolling with the Temperature and Treatment Time of the Homogenization Treatment or Less The ideal dispersed state of the intermetallic compounds is uniformly obtained in the matrix by treatment under the predetermined conditions. As a result, in the alloy in these component ranges, properties excellent in strength, electrical conductivity, and brazeability can be achieved. It has been found that when the temperature and time of the soaking treatment are higher and longer than those of the homogenization treatment, the dispersed state of the intermetallic compounds obtained by the homogenization treatment cannot be maintained due to the influence of the subsequent soaking treatment.

As described above, the aluminum alloy fin material for a heat exchanger according to the present invention comprises an aluminum alloy having a composition containing Mn: 1.2 to 2.0%, Cu: 0.05 to 0.20%, Si: 0.5 to 1.30%, Fe: 0.05 to 0.5%, and Zn: 1.0 to 3.0% in terms of % by mass and a remainder comprising Al and an unavoidable impurity and has, after heating in brazing, a tensile strength of 140 MPa or more, a proof stress of 50 MPa or more, an electrical conductivity of 42% IACS or more, an average grain diameter of 150 μm or more and less than 700 μm, and a potential of −800 mV or more and −720 mV or less, and has properties excellent in strength, electrical conductivity, and brazeability because it is fabricated by the semicontinuous casting method (DC method).

DETAILED DESCRIPTION OF THE PREFERRED EMBODIMENT

One embodiment of the present invention will be described below.

The fin material of the present invention can be manufactured, for example, by an ordinary method, and an aluminum alloy is ingoted after preparation with the composition of the present invention. The ingotting is performed by a semicontinuous casting method. The obtained aluminum alloy ingot is subjected to homogenization treatment under predetermined conditions. In other words, the homogenization treatment conditions are a treatment temperature of 350° C. to 480° C. and a treatment time of 1 to 10 hours. Then, a fin material (specimen material) having a plate thickness of 80 μm or less and a temper of H14 can be obtained through soaking treatment, hot rolling, cold rolling, and the like. The soaking treatment conditions are the temperature and treatment time of the homogenization treatment or less, desirably a temperature of 350 to 480° C. and a holding time of 1 to 10 hours. In the cold rolling, it is possible to perform cold rolling at 75% or more, perform intermediate annealing at a temperature of 300 to 400° C., and then perform final rolling at a rolling rate of 20 to 45%. The intermediate annealing need not be performed.

The fin material obtained by the above cold rolling and the like can then be subjected to corrugation processing and the like as needed. The corrugation processing can be performed by passing the fin material between two rotating dies, which allows good processing and provides excellent moldability.

The fin material obtained above, as a constituent member of a heat exchanger, is subjected to brazing in combination with other constituent members (tubes, headers, and the like). The conditions in the brazing (the brazing temperature, the atmosphere, whether a flux is used or not, the type of the brazing material, and the like) are not particularly limited, and the brazing can be performed by an ordinary method.

The heat exchanger fabricated above is used in applications such as automobiles. The fin portions of the heat exchanger use the fin material obtained above and therefore have both high strength and high thermal conductivity though being thinned.

Examples

Examples of the present invention will be described below compared with Comparative Examples.

An aluminum alloy brazing material having a composition shown in Table 1 (the remainder Al+unavoidable impurities) was melted and cast by a semicontinuous casting method. The cooling rate of the slag was 0.5 to 3.5° C./s. Further, the obtained ingot was subjected to homogenization treatment under conditions shown in Table 2 (the temperature increase rate was 25 to 75° C./h, and the cooling rate was 20 to 50° C./h). Then, soaking treatment was performed under conditions shown in Table 2 (the temperature increase rate was 25 to 75° C./h, and the cooling rate was 20 to 50° C./h), and treatment was performed in the order of hot rolling and cold rolling.

In the cold rolling step, cold rolling was performed at 75% or more, then intermediate annealing was performed at 350° C. for 6 hours, and then final rolling at a rolling rate of 40% was performed to obtain a plate material (specimen material) having a plate thickness of 0.06 μm and a temper of H14. For the obtained specimen material, conductivity and the number density of crystallized products having an equivalent circular diameter of 1.0 μm or more and second-phase particles having an equivalent circular diameter of 0.01 to 0.10 μm were calculated by methods shown below and are shown in Table 2. In addition, brazing-equivalent heating was performed under conditions shown below, and for the fin material after the heating, tensile strength, proof stress, conductivity, grain diameter, potential, elevated temperature tensile strength, high temperature proof stress, and the number density of second-phase particles having an equivalent circular diameter of 0.01 to 0.10 μm were evaluated by methods shown below.

(Brazing Treatment)

Brazing-equivalent heating was performed under the conditions of heat treatment in which the temperature was increased from room temperature to 600° C. at an average temperature increase rate of 40° C./min, held at 600° C. for minutes, and then decreased for cooling at a temperature decrease rate of 100° C./min.

(Electrical Conductivity)

The electrical conductivity was measured before brazing and after brazing by a double bridge type electrical conductivity meter by the electrical conductivity measurement method described in JIS H-0505.

(Distributed State of Compounds of Material)

For the specimen material before and after brazing, the number density (number/$\mu m^2$) of crystallized products (having an equivalent circular diameter of 1.0 μm or more) and second-phase particles (having an equivalent circular diameter of 0.01 to 0.10 μm) was measured by a transmission electron microscope (TEM). The measurement method was as follows. Before brazing, the material was subjected to salt bath annealing at 400° C. for 15 seconds to remove deformation strain to make compounds easy to observe, and then a thin film was fabricated by mechanical polishing and electrolytic polishing by a usual method. Photographs of crystallized products and second-phase particles were taken at 3000 magnification and 30000 magnification respectively by a transmission electron microscope. The photographs at 3000 magnification were taken with a field of view of 50 μm×50 μm for a total of 50 fields of views, and the photographs at 30000 magnification were taken with a field of view of 5 μm×5 μm for a total of 5 fields of views. The size and number density of dispersed particles were measured by image analysis.

(Recrystallization Temperature)

Assuming heating in brazing, the temperature was increased from ordinary temperature to about 600° C. at a constant rate of 100° C./min, and after each temperature was reached, cooling to ordinary temperature was performed. Then, a JIS No. 5 test piece was fabricated, a tensile test was carried out, and the proof stress was measured. The tensile rate was 15 mm/min. The temperature at which the proof stress value started to decrease by 20% or more compared with proof stress before brazing was taken as recrystallization start temperature, and the temperature at which the proof stress value started to decrease to within +20% compared with proof stress after heating in brazing was taken as recrystallization end temperature. They are shown in Table 2.

(Strength after Brazing)

A sample was cut from the specimen material subjected to brazing-equivalent heating parallel to the rolling direction, and a test piece having the shape of JIS No. 13 B was fabricated. A tensile test was carried out at ordinary temperature, and the tensile strength and proof stress were measured. The tensile rate was 3 mm/min. Also for high temperature strength, similarly, using a sample subjected to the brazing treatment, a tensile test was carried out at a test temperature of 115° C., and the tensile strength and proof stress were measured. The tensile rate during the elevated temperature tensile test was 1 mm/min.

(Natural Potential)

A sample for potential measurement was cut from the fin material subjected to brazing-equivalent heat treatment, immersed in a 5% NaOH solution heated to 50° C. for 30 seconds, then immersed in a 30% $HNO_3$ solution for seconds, further washed with tap water and ion-exchanged water, and immersed in a 5% NaCl solution (adjusted to pH 3 with acetic acid) at 25° C. for 60 min as it was without drying. Then, the natural potential (the reference electrode was a silver-silver chloride electrode (saturated)) was measured.

(Grain Diameter)

For the specimen material subjected to brazing-equivalent heat treatment, a sample surface was etched with a mixed liquid of hydrochloric acid, hydrofluoric acid, and nitric acid to expose grains, and using a surface grain texture photograph taken, the grain diameter was measured by a straight line cutting method.

TABLE 1

| | | Chemical components (% by mass) | | | | | | | |
|---|---|---|---|---|---|---|---|---|---|
| No. | | Mn | Si | Cu | Fe | Zn | Ti | Cr | Mg |
| Examples | 1 | 1.22 | 1.00 | 0.15 | 0.30 | 2.00 | — | — | — |
| | 2 | 1.97 | 1.00 | 0.12 | 0.30 | 2.00 | — | — | — |
| | 3 | 1.60 | 0.51 | 0.15 | 0.30 | 2.00 | — | — | — |
| | 4 | 1.60 | 1.28 | 0.09 | 0.30 | 2.00 | — | — | — |
| | 5 | 1.60 | 0.90 | 0.05 | 0.30 | 2.00 | — | — | — |
| | 6 | 1.60 | 0.90 | 0.19 | 0.20 | 2.00 | — | — | — |
| | 7 | 1.50 | 0.90 | 0.10 | 0.05 | 2.00 | — | — | — |
| | 8 | 1.50 | 0.90 | 0.10 | 0.48 | 2.00 | — | — | — |
| | 9 | 1.50 | 0.90 | 0.12 | 0.30 | 1.01 | — | — | — |
| | 10 | 1.50 | 0.90 | 0.12 | 0.30 | 2.98 | — | — | — |
| | 11 | 1.30 | 0.90 | 0.15 | 0.30 | 1.50 | 0.01 | — | — |
| | 12 | 1.30 | 0.90 | 0.15 | 0.30 | 1.50 | 0.18 | — | — |
| | 13 | 1.60 | 0.60 | 0.10 | 0.40 | 2.00 | — | 0.01 | — |
| | 14 | 1.60 | 0.60 | 0.10 | 0.40 | 2.00 | — | 0.18 | — |
| | 15 | 1.60 | 1.00 | 0.08 | 0.20 | 2.00 | — | — | 0.01 |
| | 16 | 1.60 | 1.00 | 0.08 | 0.20 | 2.00 | — | — | 0.18 |
| Comparative Examples | 1 | 1.15 | 0.70 | 0.10 | 0.30 | 1.50 | — | — | — |
| | 2 | 2.08 | 0.70 | 0.10 | 0.30 | 1.50 | — | — | — |
| | 3 | 1.50 | 0.47 | 0.10 | 0.30 | 1.50 | — | — | — |
| | 4 | 1.50 | 1.32 | 0.10 | 0.30 | 1.50 | — | — | — |
| | 5 | 1.50 | 0.90 | 0.04 | 0.20 | 2.00 | — | — | — |
| | 6 | 1.50 | 0.90 | 0.21 | 0.20 | 1.50 | — | — | — |
| | 7 | 1.60 | 0.60 | 0.15 | 0.02 | 1.50 | — | — | — |
| | 8 | 1.60 | 0.60 | 0.15 | 0.53 | 1.50 | — | — | — |
| | 9 | 1.60 | 0.80 | 0.15 | 0.30 | 0.97 | — | — | — |
| | 10 | 1.60 | 1.00 | 0.05 | 0.30 | 3.06 | — | — | — |
| | 11 | 1.60 | 0.90 | 0.10 | 0.30 | 2.00 | — | — | — |
| | 12 | 1.75 | 1.10 | 0.12 | 0.48 | 2.00 | — | — | — |
| | 13 | 1.60 | 0.90 | 0.10 | 0.20 | 2.00 | — | — | — |
| | 14 | 1.30 | 0.90 | 0.15 | 0.30 | 2.50 | — | — | 0.02 |

TABLE 2

| | | After brazing | | | | | | |
|---|---|---|---|---|---|---|---|---|
| | No. | Tensile strength | Proof stress | Electrical conductivity | Grain diameter | Potential | Elevated temperature tensile strength | High temperature proof stress |
| Examples | 1 | 143 MPa | 52 MPa | 43.0%IACS | 410 μm | −755 mV | 93 MPa | 45 MPa |
| | 2 | 157 MPa | 57 MPa | 42.6%IACS | 340 μm | −751 mV | 98 MPa | 46 MPa |
| | 3 | 143 MPa | 52 MPa | 42.4%IACS | 380 μm | −757 mV | 93 MPa | 45 MPa |
| | 4 | 159 MPa | 59 MPa | 43.1%IACS | 320 μm | −753 mV | 100 MPa | 48 MPa |
| | 5 | 144 MPa | 53 MPa | 43.2%IACS | 420 μm | −772 mV | 92 MPa | 43 MPa |
| | 6 | 152 MPa | 58 MPa | 42.4%IACS | 280 μm | −732 mV | 105 MPa | 50 MPa |
| | 7 | 144 MPa | 53 MPa | 42.8%IACS | 420 μm | −756 mV | 95 MPa | 45 MPa |
| | 8 | 148 MPa | 54 MPa | 42.5%IACS | 210 μm | −755 mV | 107 MPa | 49 MPa |
| | 9 | 144 MPa | 53 MPa | 44.2%IACS | 420 μm | −721 mV | 95 MPa | 45 MPa |
| | 10 | 144 MPa | 53 MPa | 42.1%IACS | 420 μm | −780 mV | 95 MPa | 45 MPa |
| | 11 | 143 MPa | 53 MPa | 43.0%IACS | 380 μm | −738 mV | 94 MPa | 44 MPa |
| | 12 | 145 MPa | 54 MPa | 42.2%IACS | 270 μm | −736 mV | 95 MPa | 45 MPa |
| | 13 | 143 MPa | 53 MPa | 43.4%IACS | 330 μm | −755 mV | 94 MPa | 44 MPa |
| | 14 | 145 MPa | 54 MPa | 42.2%IACS | 220 μm | −750 mV | 95 MPa | 45 MPa |
| | 15 | 145 MPa | 54 MPa | 42.7%IACS | 350 μm | −754 mV | 95 MPa | 45 MPa |
| | 16 | 147 MPa | 55 MPa | 42.2%IACS | 240 μm | −752 mV | 96 MPa | 46 MPa |
| Comparative Examples | 1 | 138 MPa | 48 MPa | 43.2%IACS | 580 μm | −742 mV | 91 MPa | 42 MPa |
| | 2 | — | — | — | — | — | — | — |
| | 3 | 137 MPa | 50 MPa | 43.2%IACS | 420 μm | −746 mV | 90 MPa | 42 MPa |
| | 4 | — | — | — | — | — | — | — |
| | 5 | 143 MPa | 52 MPa | 43.5%IACS | 450 μm | −748 mV | 87 MPa | 41 MPa |
| | 6 | 153 MPa | 58 MPa | 41.9%IACS | 240 μm | −716 mV | 108 MPa | 51 MPa |
| | 7 | 142 MPa | 52 MPa | 42.6%IACS | 520 μm | −750 mV | 89 MPa | 39 MPa |
| | 8 | 157 MPa | 55 MPa | 42.5%IACS | 170 μm | −748 mV | 116 MPa | 51 MPa |
| | 9 | 145 MPa | 53 MPa | 44.6%IACS | 350 μm | −712 mV | 95 MPa | 45 MPa |
| | 10 | 142 MPa | 52 MPa | 43.2%IACS | 380 μm | −812 mV | 92 MPa | 42 MPa |
| | 11 | 135 MPa | 47 MPa | 42.3%IACS | 180 μm | −756 mV | 87 MPa | 38 MPa |
| | 12 | 141 MPa | 51 MPa | 42.4%IACS | 130 μm | −750 mV | 90 MPa | 41 MPa |
| | 13 | 136 MPa | 48 MPa | 42.3%IACS | 220 μm | −756 mV | 88 MPa | 40 MPa |
| | 14 | 141 MPa | 51 MPa | 41.8%IACS | 130 μm | −754 mV | 91 MPa | 41 MPa |

| | | Before brazing | | | Compounds | Recrystallization temperature | | Manufacturing process | |
|---|---|---|---|---|---|---|---|---|---|
| | No. | Electrical conductivity | Compounds 1.0 μm or more | Compounds 0.01~0.1 μm | after brazing 0.01~0.1 μm | Start temperature | End temperature | Homogenization treatment | Soaking treatment |
| Examples | 1 | 46.5%IACS | $2.0 \times 10^4$ | $7.8 \times 10^4$ | $3.3 \times 10^4$ | 400 | 500 | 450° C. × 8 h | 430° C. × 4 h |
| | 2 | 45.6%IACS | $4.2 \times 10^4$ | $2.3 \times 10^5$ | $7.9 \times 10^4$ | 400 | 500 | 450° C. × 8 h | 430° C. × 4 h |
| | 3 | 46.5%IACS | $2.0 \times 10^4$ | $2.4 \times 10^5$ | $8.2 \times 10^4$ | 400 | 500 | 450° C. × 8 h | 450° C. × 4 h |
| | 4 | 45.6%IACS | $4.2 \times 10^4$ | $2.3 \times 10^5$ | $7.9 \times 10^4$ | 400 | 500 | 450° C. × 8 h | 450° C. × 4 h |
| | 5 | 46.1%IACS | $2.3 \times 10^4$ | $2.6 \times 10^5$ | $7.3 \times 10^4$ | 400 | 500 | 450° C. × 8 h | 450° C. × 4 h |
| | 6 | 45.4%IACS | $1.7 \times 10^4$ | $3.3 \times 10^5$ | $1.1 \times 10^5$ | 400 | 500 | 450° C. × 8 h | 450° C. × 4 h |
| | 7 | 45.8%IACS | $8.9 \times 10^3$ | $3.1 \times 10^5$ | $9.7 \times 10^4$ | 430 | 530 | 400° C. × 10 h | 400° C. × 4 h |
| | 8 | 45.6%IACS | $4.6 \times 10^4$ | $1.9 \times 10^5$ | $5.4 \times 10^4$ | 430 | 530 | 400° C. × 10 h | 400° C. × 4 h |
| | 9 | 47.7%IACS | $2.2 \times 10^4$ | $2.1 \times 10^5$ | $7.7 \times 10^4$ | 430 | 530 | 400° C. × 10 h | 400° C. × 4 h |
| | 10 | 45.8%IACS | $2.4 \times 10^4$ | $2.4 \times 10^5$ | $7.5 \times 10^4$ | 430 | 530 | 450° C. × 8 h | 400° C. × 4 h |
| | 11 | 46.1%IACS | $2.1 \times 10^4$ | $1.2 \times 10^5$ | $6.5 \times 10^4$ | 430 | 530 | 450° C. × 8 h | 400° C. × 4 h |
| | 12 | 45.3%IACS | $2.0 \times 10^4$ | $1.6 \times 10^5$ | $6.6 \times 10^4$ | 380 | 480 | 380° C. × 10 h | 380° C. × 6 h |
| | 13 | 46.0%IACS | $4.0 \times 10^4$ | $7.5 \times 10^4$ | $3.5 \times 10^4$ | 380 | 480 | 380° C. × 10 h | 380° C. × 6 h |
| | 14 | 45.4%IACS | $3.9 \times 10^4$ | $7.3 \times 10^4$ | $3.4 \times 10^4$ | 380 | 480 | 470° C. × 4 h | 450° C. × 4 h |
| | 15 | 45.7%IACS | $2.2 \times 10^4$ | $2.5 \times 10^5$ | $8.2 \times 10^5$ | 440 | 510 | 470° C. × 4 h | 450° C. × 4 h |
| | 16 | 45.3%IACS | $2.4 \times 10^4$ | $2.4 \times 10^5$ | $7.8 \times 10^5$ | 440 | 510 | 430° C. × 6 h | 420° C. × 4 h |
| Comparative Examples | 1 | 46.2%IACS | $1.2 \times 10^4$ | $6.7 \times 10^4$ | $1.4 \times 10^4$ | 400 | 510 | 430° C. × 6 h | 420° C. × 4 h |
| | 2 | — | — | — | — | — | — | — | — |
| | 3 | 46.2%IACS | $2.2 \times 10^4$ | $2.0 \times 10^5$ | $7.7 \times 10^4$ | 400 | 510 | 450° C. × 8 h | 430° C. × 4 h |
| | 4 | 44.8%IACS | $2.4 \times 10^4$ | $2.1 \times 10^5$ | — | 400 | 510 | 450° C. × 8 h | 430° C. × 4 h |
| | 5 | 46.5%IACS | $2.2 \times 10^4$ | $2.6 \times 10^5$ | $7.2 \times 10^4$ | 400 | 510 | 450° C. × 8 h | 450° C. × 4 h |
| | 6 | 44.8%IACS | $1.8 \times 10^4$ | $3.3 \times 10^5$ | $1.2 \times 10^5$ | 400 | 510 | 470° C. × 4 h | 450° C. × 4 h |
| | 7 | 45.6%IACS | $8.7 \times 10^3$ | $3.1 \times 10^5$ | $9.4 \times 10^4$ | 400 | 510 | 470° C. × 4 h | 450° C. × 4 h |
| | 8 | 45.5%IACS | $4.4 \times 10^4$ | $2.0 \times 10^5$ | $5.2 \times 10^4$ | 400 | 510 | 450° C. × 10 h | 450° C. × 4 h |
| | 9 | 47.6%IACS | $2.3 \times 10^4$ | $2.2 \times 10^5$ | $8.2 \times 10^4$ | 450 | 550 | 400° C. × 10 h | 400° C. × 4 h |
| | 10 | 46.2%IACS | $2.2 \times 10^4$ | $2.4 \times 10^5$ | $7.4 \times 10^4$ | 450 | 550 | 400° C. × 10 h | 400° C. × 4 h |
| | 11 | 45.4%IACS | $2.6 \times 10^4$ | $4.8 \times 10^4$ | $8.4 \times 10^3$ | 260 | 340 | 520° C. × 10 h | 520° C. × 4 h |
| | 12 | 45.4%IACS | $5.2 \times 10^4$ | $4.7 \times 10^4$ | $1.1 \times 10^4$ | 330 | 440 | 450° C. × 10 h | 520° C. × 4 h |
| | 13 | 45.4%IACS | $2.8 \times 10^4$ | $5.2 \times 10^4$ | $8.2 \times 10^3$ | 330 | 440 | 550° C. × 10 h | 450° C. × 4 h |
| | 14 | 45.1%IACS | $5.6 \times 10^4$ | $4.5 \times 10^4$ | $8.6 \times 10^3$ | 260 | 340 | 550° C. × 12 h | 550° C. × 10 h |

All the Examples of the present invention exhibited high strength, high conductivity, and high brazeability compared with the Comparative Examples, whereas the Comparative Examples could not satisfy all of high strength, high conductivity, and high brazeability. In Comparative Example 2, a fin material could not be manufactured, and in Comparative Example 4, the fin material melted locally when brazing-equivalent heating was performed, and could not be evaluated.

The present invention has been described above based on the above embodiment and Examples. Appropriate changes can be made in the above embodiment and the above Examples without departing from the scope of the present invention.

What is claimed is:

1. An aluminum alloy fin material for a heat exchanger comprising an aluminum alloy having a composition containing Mn: 1.2 to 2.0%, Cu: 0.05 to 0.20%, Si: 0.5 to 1.30%, Fe: 0.05 to 0.35%, and Zn: 1.0 to 3.0% in terms of % by mass and a remainder comprising Al and an unavoidable impurity, wherein, after brazing-equivalent heating, the aluminum alloy fin material has a tensile strength of 140 MPa or more, a proof stress of 50 MPa or more, an electrical conductivity of 42% IACS or more, an average grain diameter of 150 μm or more and less than 700 μm, and a potential in a range of −800 mV to −720 mV, wherein the aluminum alloy fin material has an electrical conductivity of 45% IACS or more before brazing, and wherein, in the aluminum alloy fin material before brazing, less than $5.0\times10^4/mm^2$ of crystallized products having an equivalent circular diameter of 1.0 μm or more and $5.0\times10^4/mm^2$ or more of Al—Mn—based, Al—Mn—Si-based, and Al—Fe—Si-based second-phase particles having an equivalent circular diameter of 0.01 to 0.10 μm are present.

2. The aluminum alloy fin material for a heat exchanger according to claim 1, wherein the aluminum alloy further contains at least one of Ti: 0.01 to 0.20%, Cr: 0.01 to 0.20%, and Mg: 0.01 to 0.20% in terms of % by mass.

3. The aluminum alloy fin material for a heat exchanger according to claim 1, wherein after the brazing-equivalent heating, the aluminum alloy fin material has, at 115° C., a tensile strength of 90 MPa or more and a proof stress of 40 MPa or more.

4. The aluminum alloy fin material for a heat exchanger according to claim 1, wherein, after the brazing-equivalent heating, $1.0\times10^4/mm^2$ or more of Al—Mn—based, Al—Mn—Si-based, and Al—Fe—Si-based second-phase particles having an equivalent circular diameter of 0.01 to 0.10 μm are present.

5. The aluminum alloy fin material for a heat exchanger according to claim 1, having a plate thickness of 80 μm or less.

6. The aluminum alloy fin material for a heat exchanger according to claim 1, having a recrystallization start temperature and a recrystallization end temperature in a range of 350° C. to 550° C., during heating for brazing.

7. A heat exchanger comprising the aluminum alloy fin material for a heat exchanger according to claim 1.

8. A method for manufacturing the aluminum alloy fin material for a heat exchanger according to claim 1, the method comprising:

casting, by a semicontinuous casting method, a molten aluminum alloy having a composition containing Mn: 1.2 to 2.0%, Cu: 0.05 to 0.20%, Si: 0.5 to 1.30%, Fe: 0.05 to 0.35%, and Zn: 1.0 to 3.0% in terms of % by mass and a remainder comprising Al and an unavoidable impurity;

subjecting an ingot obtained in the casting to homogenization treatment at a treatment temperature of 350° C. to 480° C. for a treatment time of 1 to 10 hours; and carrying out soaking treatment with the temperature and treatment time of the homogenization treatment or less before hot rolling.

9. A method for manufacturing the aluminum alloy fin material for a heat exchanger according to claim 2, the method comprising:

casting, by a semicontinuous casting method, a molten aluminum alloy having a composition containing Mn: 1.2 to 2.0%, Cu: 0.05 to 0.20%, Si: 0.5 to 1.30%, Fe: 0.05 to 0.35%, and Zn: 1.0 to 3.0% in terms of % by mass, at least one of Ti: 0.01 to 0.20%, Cr: 0. 01 to 0.20%, and Mg: 0.01 to 0.20% in terms of % by mass, and a remainder comprising Al and an unavoidable impurity;

subjecting an ingot obtained in the casting to homogenization treatment at a treatment temperature of 350° C. to 480° C. for a treatment time of 1 to 10 hours; and carrying out soaking treatment with the temperature and treatment time of the homogenization treatment or less before hot rolling.

* * * * *